US011824298B2

(12) United States Patent
Schneider

(10) Patent No.: US 11,824,298 B2
(45) Date of Patent: Nov. 21, 2023

(54) MULTI-PART CONTACT

(71) Applicant: Interplex Industries, Inc., East Providence, RI (US)

(72) Inventor: Richard Schneider, Livonia, MI (US)

(73) Assignee: Interplex Industries, Inc., East Providence, RI (US)

( * ) Notice: Subject to any disclaimer, the term of this patent is extended or adjusted under 35 U.S.C. 154(b) by 193 days.

(21) Appl. No.: 17/427,632

(22) PCT Filed: Feb. 7, 2020

(86) PCT No.: PCT/US2020/017208

§ 371 (c)(1),
(2) Date: Jul. 31, 2021

(87) PCT Pub. No.: WO2020/167603

PCT Pub. Date: Aug. 20, 2020

(65) Prior Publication Data

US 2022/0102896 A1 Mar. 31, 2022

Related U.S. Application Data

(60) Provisional application No. 62/835,577, filed on Apr. 18, 2019, provisional application No. 62/803,915, filed on Feb. 11, 2019.

(51) Int. Cl.
*H01R 13/24* (2006.01)
*H01R 12/52* (2011.01)
(Continued)

(52) U.S. Cl.
CPC ..... *H01R 13/2428* (2013.01); *H01R 12/523* (2013.01); *H01R 12/585* (2013.01); *H01R 12/707* (2013.01)

(58) Field of Classification Search
CPC ..... H01R 13/2428; H01R 12/523; H01R 12/585; H01R 12/707; H01R 12/7064;
(Continued)

(56) References Cited

U.S. PATENT DOCUMENTS 6,184,587 B1 2/2001 Khandros
6,997,727 B1 2/2006 Legrady
(Continued)

OTHER PUBLICATIONS

International Search Report for PCT/US2020/017208 dated Jun. 5, 2020.
Written Opinion of ISA for PCT/US2020/017208 dated Jun. 5, 2020.

*Primary Examiner* — Truc T Nguyen
(74) *Attorney, Agent, or Firm* — Katterle Nupp LLC; Paul Katterle; Robert Nupp

(57) ABSTRACT

An electrical contact is provided for connecting together substrates. The electrical contact has a longitudinal axis and includes first and second structures that are connected together to prevent relative movement between each other. The first structure extends along the longitudinal axis and has a rigid construction. The second structure includes a spring portion and a mounting portion. The spring portion is resiliently deflectable in the direction of the longitudinal axis. The mounting portion is adapted for securement to one of the substrates. A press-fit portion is provided that extends along the longitudinal axis and is adapted for press-fit insertion into a hole of the other one of the substrates. The press-fit portion may be part of the first structure or the second structure. In addition, the first structure may be composed of metal or plastic.

16 Claims, 15 Drawing Sheets

(51) Int. Cl.
*H01R 12/58* (2011.01)
*H01R 12/70* (2011.01)

(58) Field of Classification Search
CPC .... H01R 12/716; H01R 12/724; H01R 12/57; H01R 12/58; H01R 12/52; H01R 13/6587; H01R 12/7076
See application file for complete search history.

(56) References Cited

U.S. PATENT DOCUMENTS

| | | | | |
|---|---|---|---|---|
| 7,175,488 | B2 | 2/2007 | Pavlovic | |
| 10,224,655 | B2 | 3/2019 | Yao | |
| 2007/0010139 | A1 | 1/2007 | Chen | |
| 2009/0197439 | A1 | 8/2009 | Nabilek | |
| 2014/0199861 | A1 | 7/2014 | Mattiuzzo | |
| 2015/0364847 | A1* | 12/2015 | Yao | H01R 12/585 439/869 |
| 2016/0141782 | A1* | 5/2016 | Miyake | H01R 12/7076 439/884 |
| 2016/0329542 | A1 | 11/2016 | Tyler | |
| 2017/0170084 | A1 | 6/2017 | Yao | |
| 2017/0170582 | A1* | 6/2017 | Yao | H01R 43/02 |
| 2020/0274294 | A1* | 8/2020 | Lynch | H01R 13/405 |
| 2020/0375037 | A1* | 11/2020 | Tate | H01R 12/523 |
| 2020/0412034 | A1* | 12/2020 | Hoyack | H05K 3/368 |
| 2021/0194165 | A1* | 6/2021 | Hachadorian | H01R 13/052 |
| 2023/0088468 | A1* | 3/2023 | Brungard | H01R 13/502 439/701 |

* cited by examiner

MULTI-PART CONTACT

CROSS-REFERENCE TO RELATED APPLICATION(S)

This application is the U.S. national phase of PCT Application No. PCT/US2020/017208 filed on 7 Feb. 2020, which claims the benefit of priority under 35 U.S.C. § 119(e) to U.S. Provisional Patent Application No. 62/803,915 filed on Feb. 11, 2019, and U.S. Provisional Patent Application No. 62/835,577 filed on Apr. 18, 2019, which are both herein incorporated by reference.

TECHNICAL FIELD

This disclosure relates generally to electrical contacts and, more particularly, to electrical contacts for interconnecting electrical/electronic substrates, such as printed circuit boards (PCB) and/or connecting a substrate to an electrical or electronic device.

BACKGROUND

Electrical contacts are widely used to interconnect electrical/electronic substrates and/or to connect electrical/electronic devices to such substrates. Some contacts are configured to have multiple types of connections. One such multi-connection type of contact has an end that is surface mounted to an electrical/electronic substrate, such as by soldering, while the other end is press-fit into a plated hole of another electrical/electronic substrate or other type of electrical/electronic device. Typically, the surface mounting of the contact occurs first, followed by the press-fitting. In such a case, when the contact is press-fit into the plated hole, a significant amount of stress is placed on the surface mounting bond, which may cause it to break. Accordingly, many multi-connection contacts are provided with a deformable segment to absorb some of the force that is applied during the press-fitting. These contacts, however, are typically difficult to manufacture and often result in wasted material. Accordingly, there is a need for a multi-connection contact with a deformable segment, wherein the contact is simple to produce and does not result in wasted material. The present disclosure is directed to such a contact.

SUMMARY

In accordance with the disclosure, an electrical contact is provided for connecting together substrates. The electrical contact has a longitudinal axis and includes first and second structures. The first structure extends along the longitudinal axis and has a rigid construction. The second structure includes a spring portion and a mounting portion. The spring portion is resiliently deflectable in the direction of the longitudinal axis. The mounting portion is adapted for securement to one of the substrates. One of the first and second structures includes a press-fit portion that extends along the longitudinal axis and is adapted for press-fit insertion into a hole of the other one of the substrates. The first and second structures are connected together to prevent relative movement between each other in at least the direction of the longitudinal axis.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
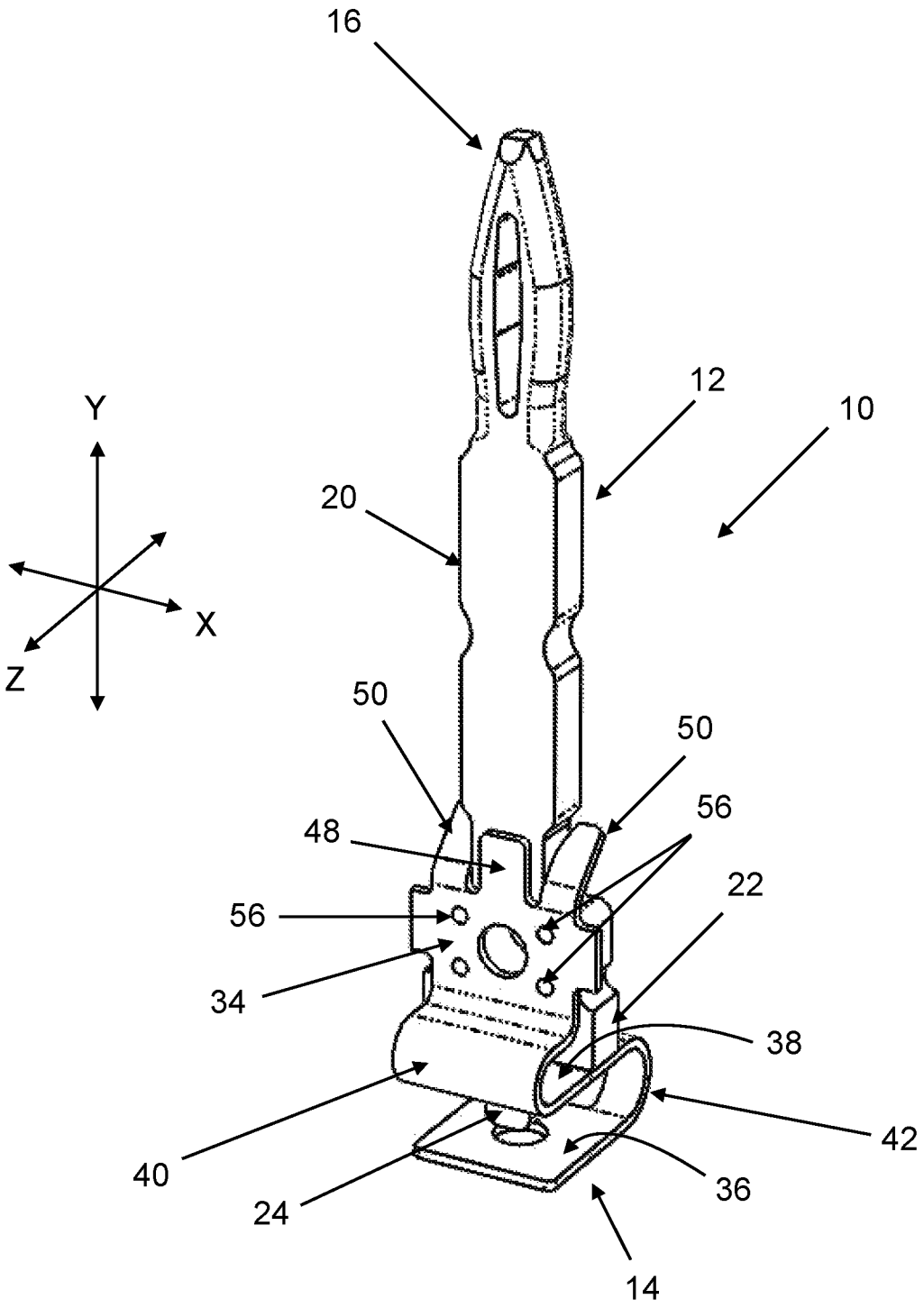
FIG. 1 shows a front perspective view of a first embodiment of an electrical contact.

It should be noted that in the detailed description that follows, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Spatially relative terms, such as "top", "bottom", "lower", "above", "upper", and the like, are used herein merely for ease of description to describe one element or feature's relationship to another element(s) or feature(s) as they are illustrated in (a) drawing figure(s) being referred to. It will be understood that the spatially relative terms are not meant to be limiting and are intended to encompass different orientations of the device in use or operation in addition to the orientation depicted in the drawings.

As used herein, the term "printed circuit board" and its acronym "PCB" shall mean any substrate that mechanically supports and electrically connects electrical or electronic components using conductive tracks, pads and/or other structures formed from one or more layers of conductive metal. A printed circuit board may be single-sided, double-sided, multilayered, rigid, flexible and/or have a metal core.

Figure 2:
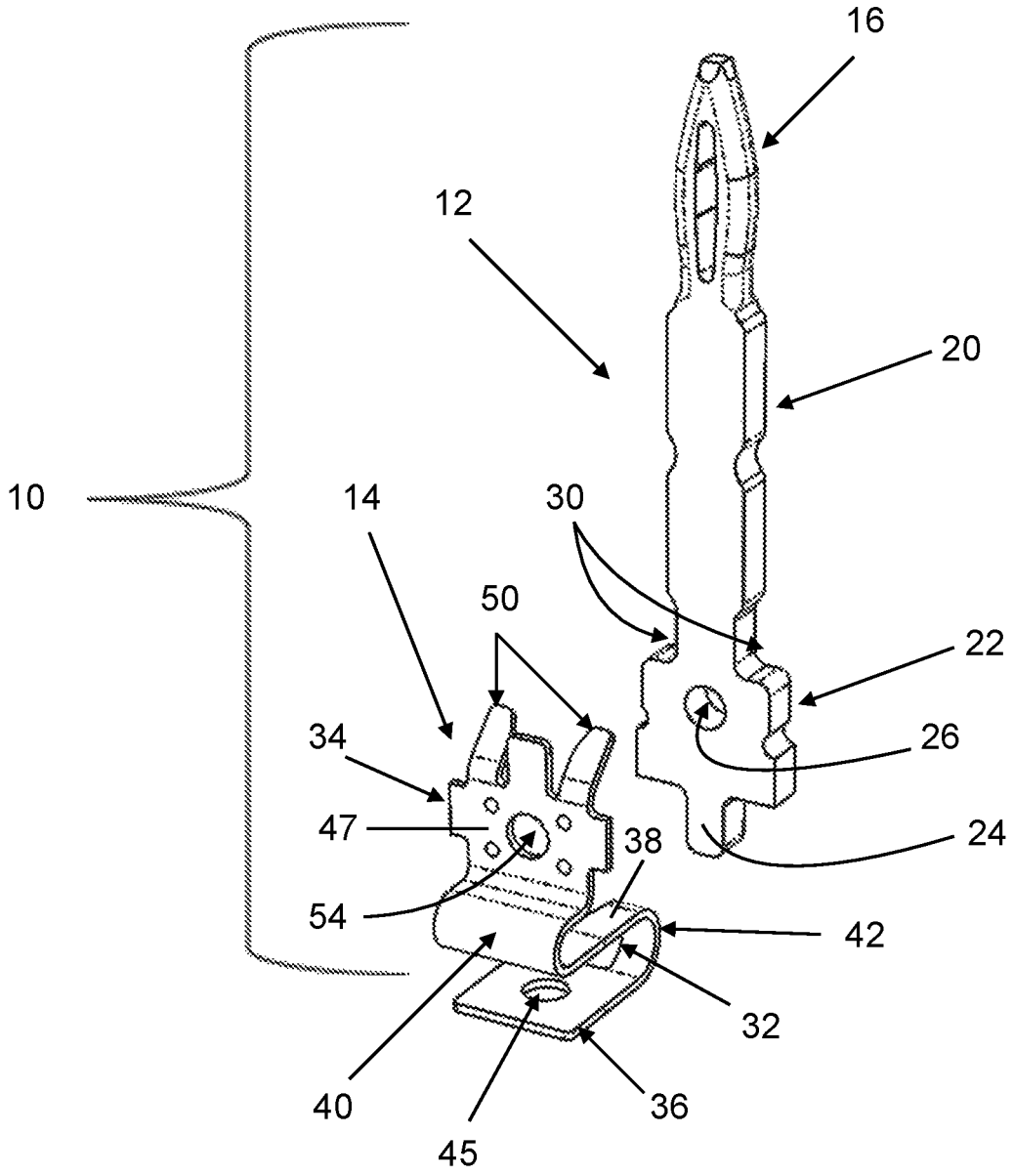
FIG. 2 shows an exploded front perspective view of the electrical contact of FIG. 1, wherein a first structure of the electrical contact is separated from a second structure of the electrical contact.
Figure 3:
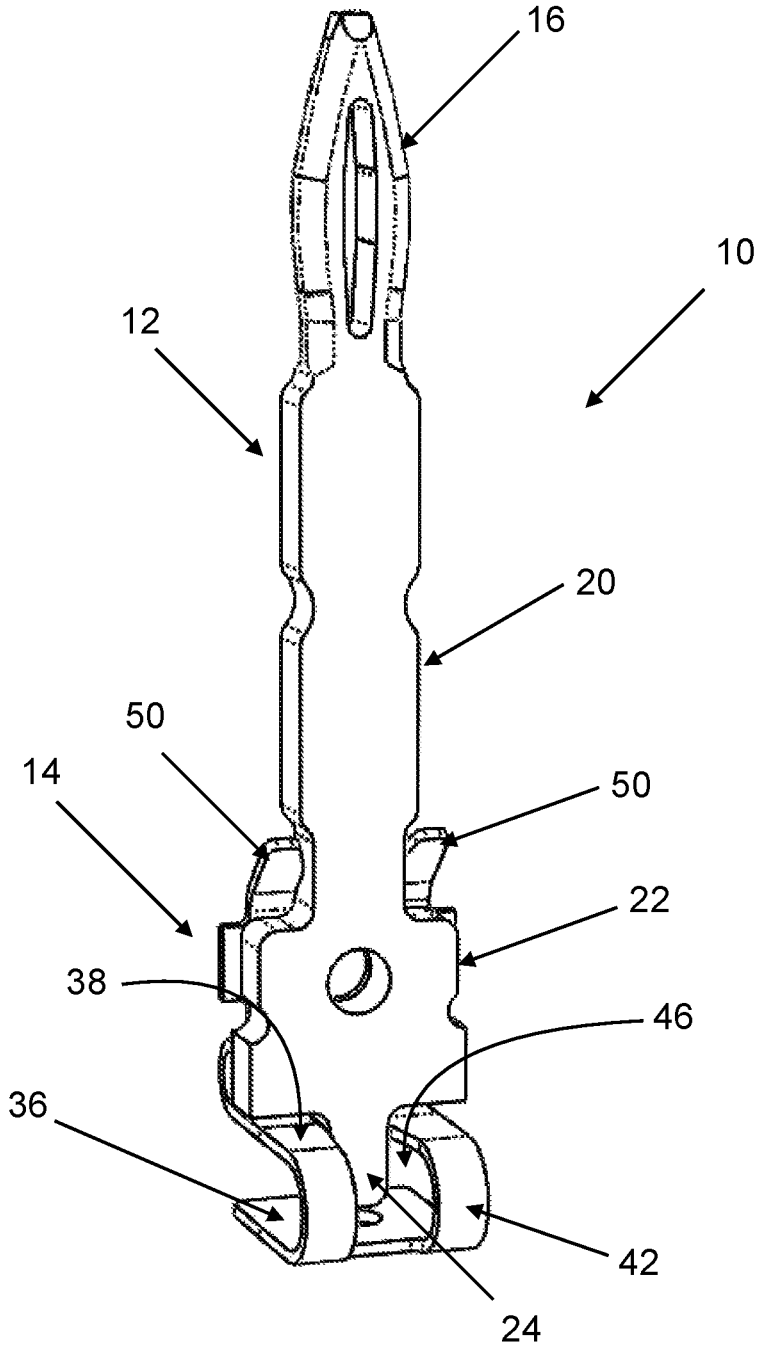
FIG. 3 shows a rear perspective view of the electrical contact of FIG. 1.

Referring now to FIGS. 1-3, there is shown a multi-part electrical contact 10 constructed in accordance with a first embodiment of this disclosure. The contact 10 is elongated, having a longitudinal axis extending in the Y direction, a width extending in the X direction and a depth or thickness extending in the Z direction. The contact 10 has a two-part construction that includes a top, first structure 12 and a bottom, second structure 14. The first structure 12 is secured to the second structure 14, such as by welding. Both the first structure 12 and the second structure 14 are comprised of electrically conductive metal, such as a tin-plated copper alloy. The first structure 12 may have a different metal composition than the second structure 14. For example the first structure 12 may be comprised of a first type of copper alloy, while the second structure 14 may be comprised of a second type of copper alloy, wherein the first type of copper alloy is more rigid than the second type of copper alloy. As described below, the contact 10 is especially suited for connecting together two substrates, such as two printed circuit boards (PCBs) or a PCB and another type of electrical/electronic substrate, such as a direct bonded copper substrate.

The first structure 12 is rigid and includes a mounting or press-fit portion 16 that is configured for press-fit insertion in the Y direction, into a plated hole of a printed circuit board (PCB) or other type of electrical/electronic substrate. The press-fit portion 16 may have an eye-of-the-needle construction (EON), with two beams separated by a piercing. The press-fit portion 16 is joined by a body portion 20 to a base portion 22. A tab 24 extends downwardly from a bottom edge of the base portion 22. A circular hole 26 (shown best in FIG. 2) passes through the base portion 22 and functions as an alignment feature, as will be described below. A pair of indentations 30 are formed in the body portion 20, toward the base portion 22.

Figure 4:
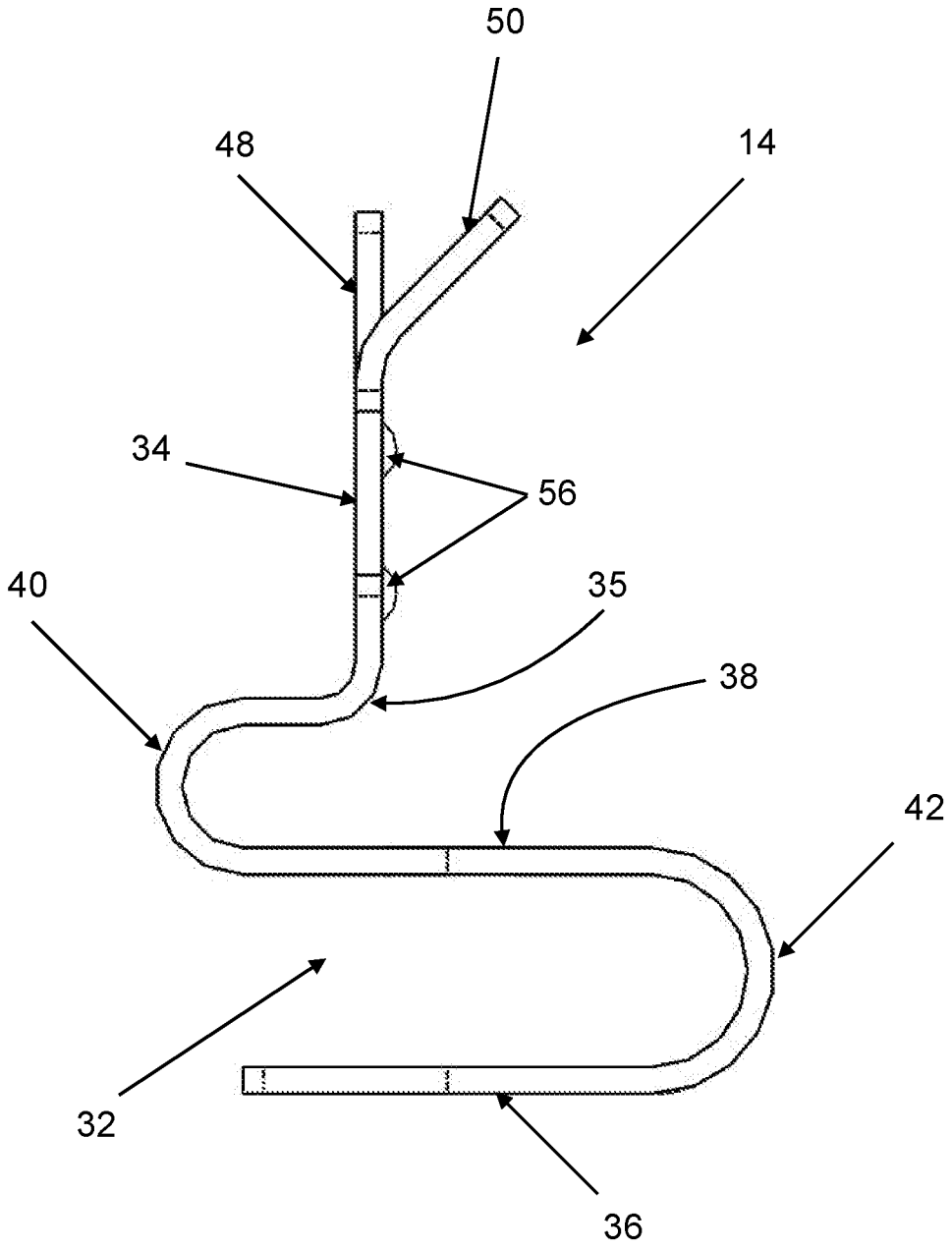
FIG. 4 shows a side elevational view of the second structure of the electrical contact of FIG. 1.
Figure 5:
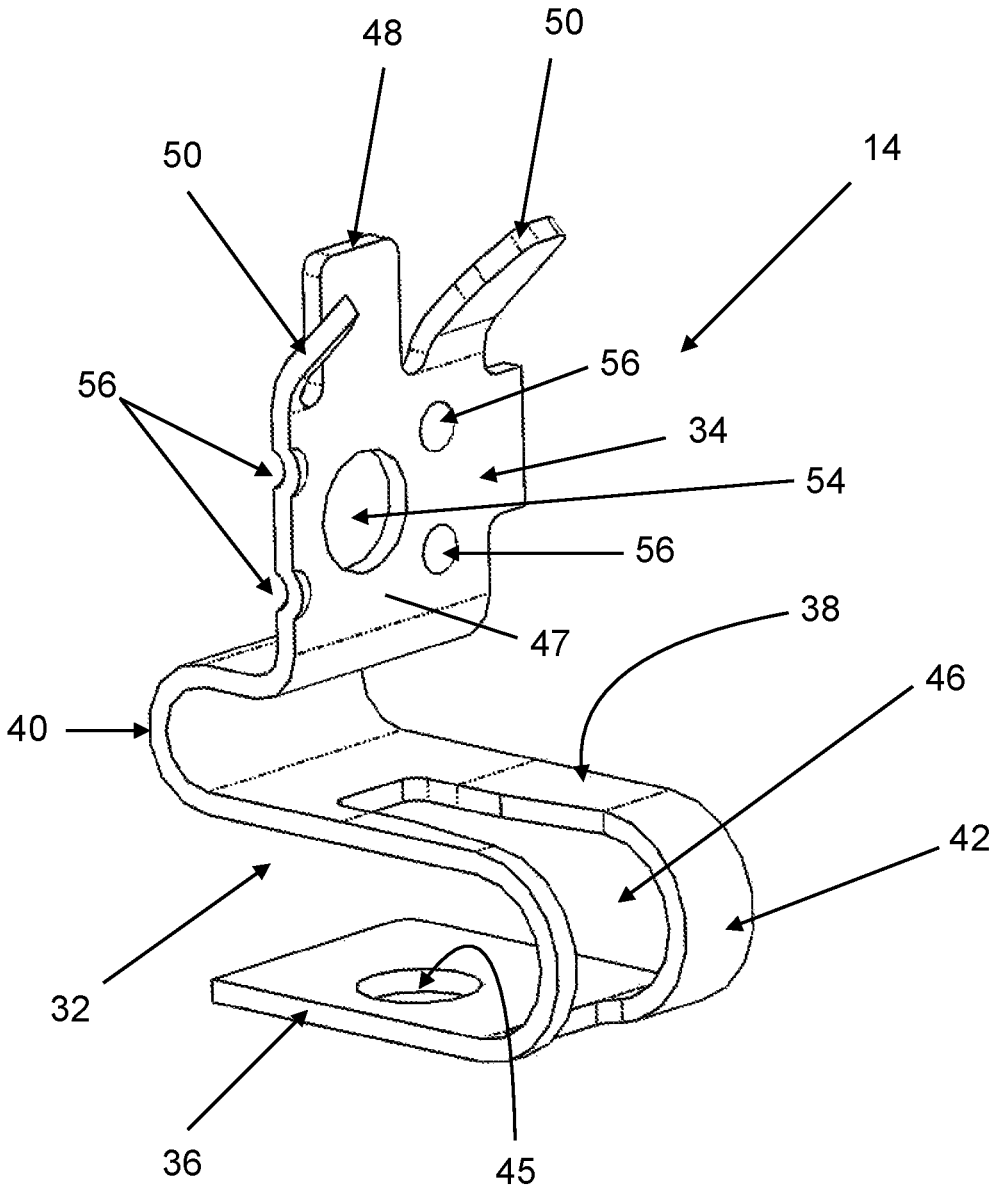
FIG. 5 shows a rear perspective view of the second structure of the electrical contact of FIG. 1, wherein a portion of the second structure has been cut away.

Referring now also to FIGS. 4 and 5, the second structure 14 includes a spring portion 32 joined between a support portion 34 and a mounting portion 36. The spring portion 32 includes a middle part 38 joined between anterior and posterior bends 40, 42, which are oppositely-directed. An interior bend 35 connects the spring portion 32 to the support portion 34. The middle part 38 is substantially parallel to the mounting portion 36, with both the middle part 38 and the mounting portion 36 being substantially horizontally disposed. The posterior bend 42 connects the middle part 38 to the mounting portion 36, which is substantially flat so as to be adapted for securement, such as by soldering, to a pad of a PCB or other electrical/electronic substrate. A hole 45 extends through the mounting portion 36, while a slot 46 (shown best in FIG. 3) extends through the posterior bend 42 and the middle part 38. The bends 35, 40, 42 permit the spring portion 32 to be resiliently deflectable in the longitudinal or Y direction, as well as in the X direction and the Z direction.

The support portion 34 of the second structure 14 has a main body 47 joined to a center tab 48 and a pair of arms 50, with the center tab 48 being disposed between the arms 50. The center tab 48 extends upwardly from the main body 47, while the arms 50 are bent so as to extend upwardly and rearwardly from the main body 47. As such, the arms 50 are disposed in a different plane than the center tab 48 and the main body 47. A circular hole 54 passes through the main body 47. The hole 54 and the arms 50 function as alignment features. A plurality of deformations 56 may be formed in the main body 47 to facilitate the welding of the support portion 34 to the base portion 22 of the first structure 12, as will be described below. The deformations 56 comprise indentations in a front surface of the main body 47 and raised bosses on a rear surface of the main body 47, as best shown in FIGS. 4 and 5.

As set forth above, the second structure 14 is secured to the first structure 12 to form the electrical contact 10. However, before they are secured together, the two sections are aligned with each other. The hole 54 in the second structure 14 is aligned with the hole 26 in the first structure 12 and the arms 50 of the second structure 14 are aligned with the body portion 20 of the first structure 12 such that the arms 50 extend into the indentations 30. With the second structure 14 and the first structure 12 so aligned, the main body 47 of the second structure 14 is welded to the base portion 22 of the first structure 12, such as by resistive, laser, e-beam, or ultrasonic welding. The deformations 56 provide focal points for welding currents when performing the welds.

When the second structure 14 and the first structure 12 are secured together, the aligned holes 26, 54 form a through hole that extends through the electrical contact 10 in the Z-direction. In addition, the tab 24 of the base portion 22 of the first structure 12 extends through the slot 46 in the spring portion 32 of the second structure 14. Moreover, the bottom edge of the base portion 22 is in contact with, or in close proximity to, the middle part 38 on opposite sides of the slot 46. In this manner, when a downwardly-directed force is applied to the press-fit portion 16, the base portion 22 contacts the middle part 38 and transfers a portion of the force to the middle part 38 of the spring portion 32. Some of the downwardly-directed force is also transferred to the anterior bend 40 of the spring portion 32 through the support portion 34. The force transferred to the spring portion 32 causes the spring portion 32 to deflect and absorb the force.

Figure 6:
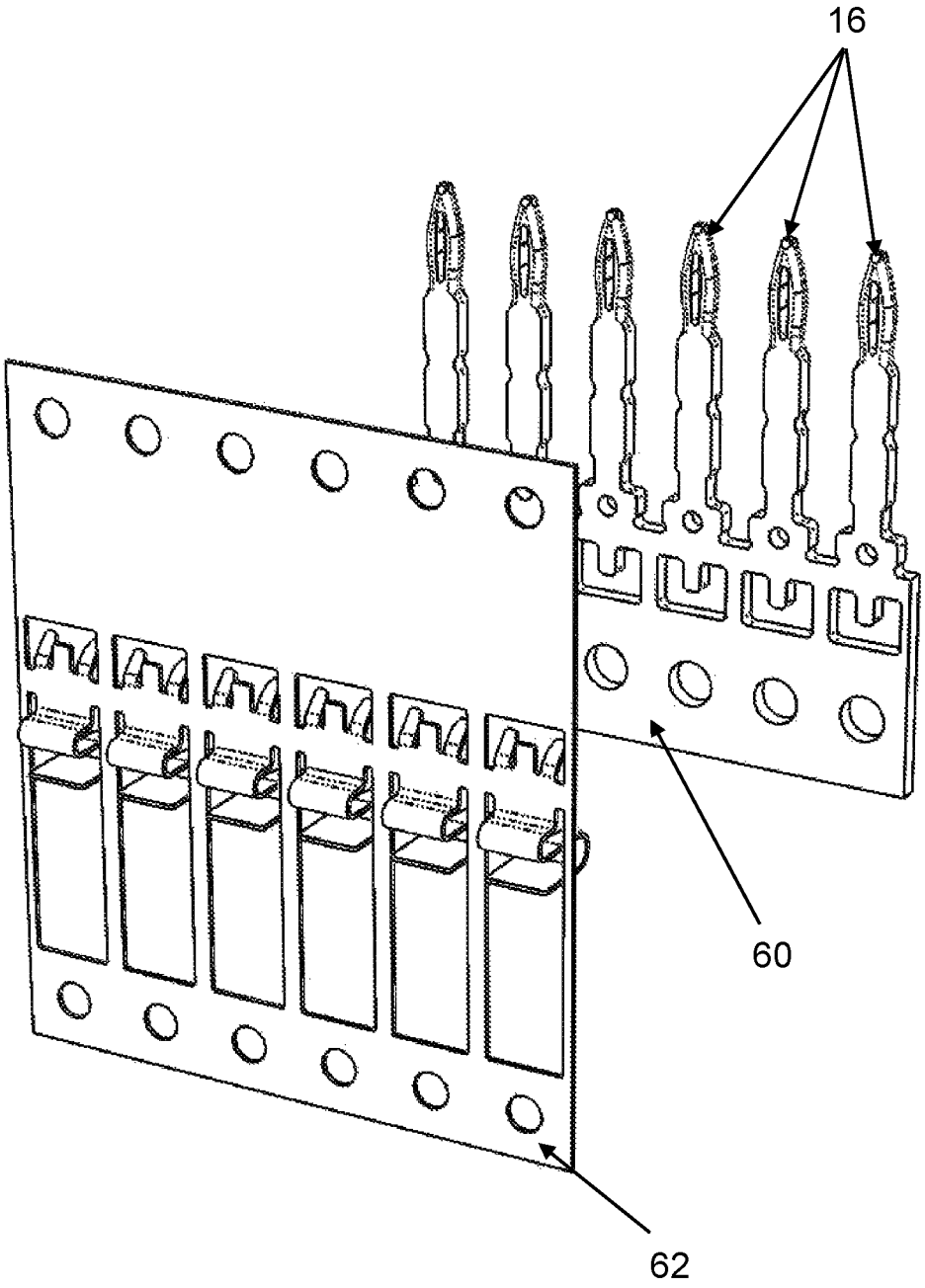
FIG. 6 shows a perspective view of of a first blank that has been partially stamped to form a plurality of partially-formed first structures for forming electrical contacts of FIG. 1, and a second blank that has been partially stamped to form a plurality of partially-formed second structures for forming electrical contacts of FIG. 1.

The two-part construction of the electrical contact 10 allows it to be constructed from two different sheets or blanks of metal, having different thicknesses. More specifically, the first structure 12 and the second structure 14 may be formed by stamping in separate operations, using metal blanks of different thicknesses. In this regard, FIG. 6 shows a first blank 60 that has been partially stamped to form a plurality of partially-formed first structures 12 and a second blank 62 that has been partially stamped to form a plurality of partially-formed second structures 14. The first blank 60 is thicker than the second blank 62. For example, the first blank 60 may be at least twice as thick as the second blank 62. In some embodiments, the first blank 60 may be three times or more than four times as thick as the second blank 62. It should also be appreciated that the first blank 60 and the second blank 62 may be formed from different types of metal.

Since the first structure 12 and the second structure 14 may be formed from metal blanks of different thicknesses, the second structure 14 may be formed from thin, flexible metal that allows the spring portion 32 to be resiliently deflectable in the Y-direction (as well as the X and Z directions), while the first structure 12 may be formed from thick metal that is rigid and does not deform in the Y-direction.

Figure 7:
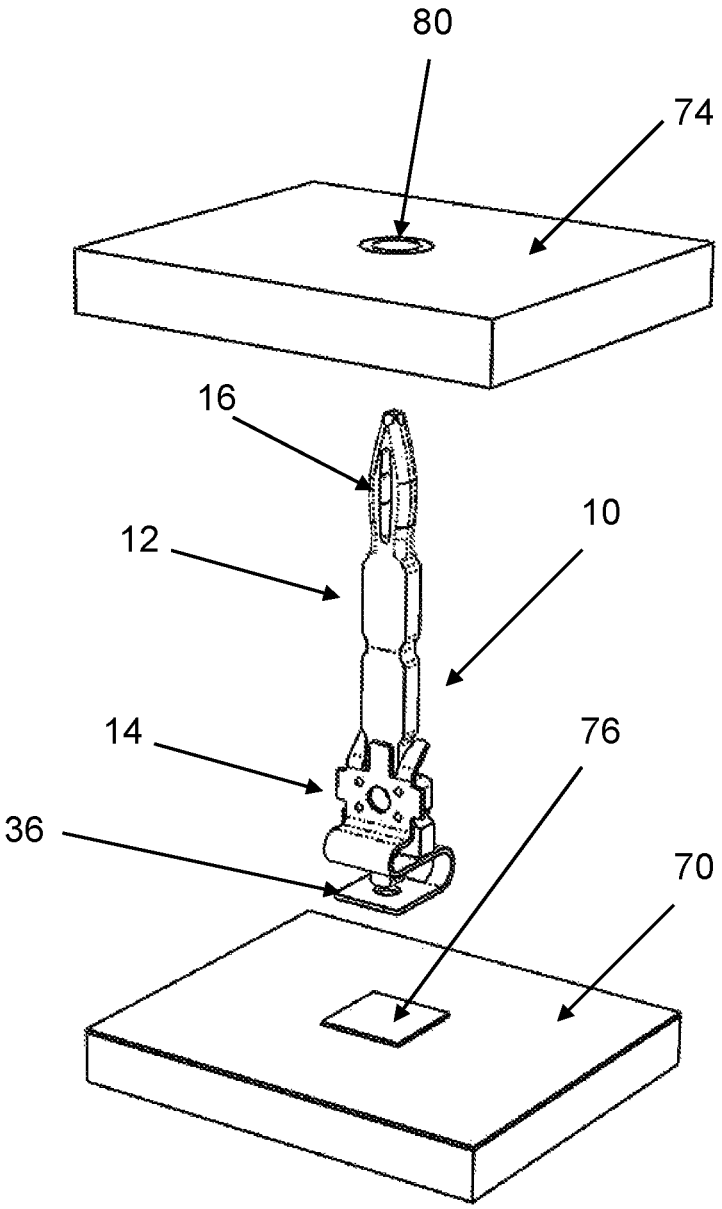
FIG. 7 shows a front perspective view of the electrical contact of FIG. 1 spaced between first and second electrical/electronic substrates.
Figure 8:
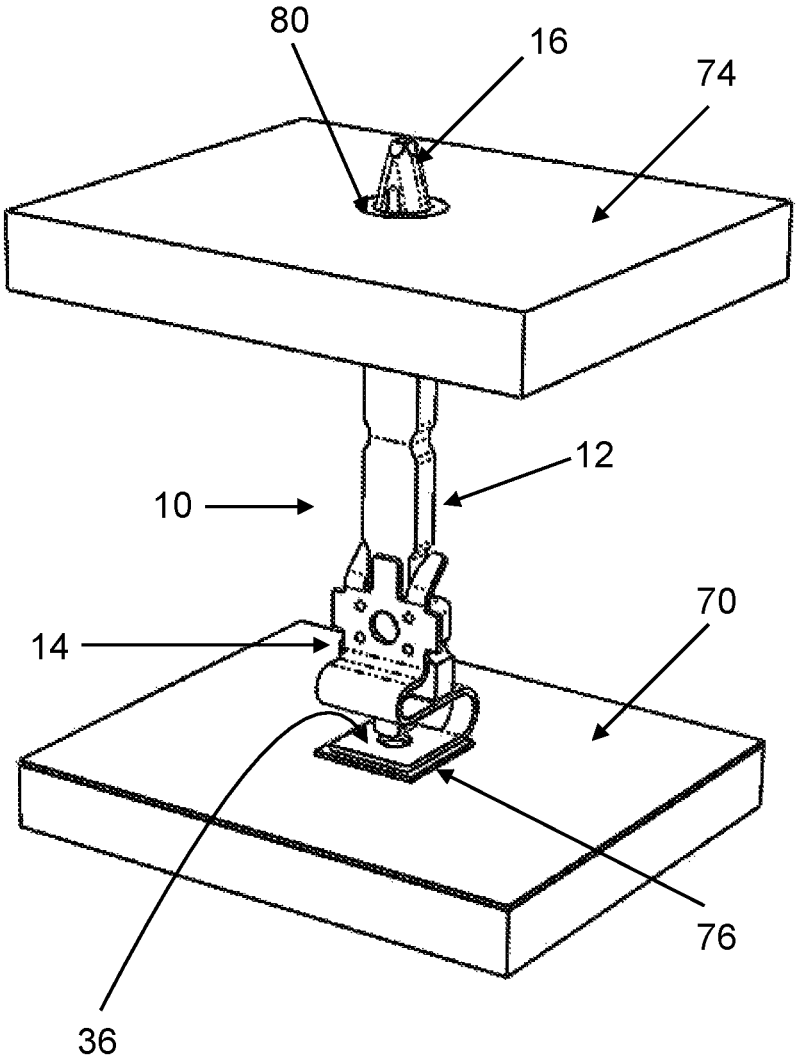
FIG. 8 shows a front perspective view of the electrical contact of FIG. 1 connecting together the first and second electrical/electronic substrates.

Referring now to FIGS. 7 and 8, the electrical contact 10 is especially well suited for connecting together spaced-apart substrates, such as substrate 70 and substrate 74. The substrates 70, 74 may each be a PCB or other type of electrical/electronic substrate. The substrate 70 has an electrically conductive metal pad 76 that is electrically connected to circuitry (not shown) in the substrate 70, while the substrate 74 has a metal-plated hole 80 that is electrically connected to circuitry (not shown) in the substrate 74. Typically, the mounting portion 36 of the electrical contact 10 is secured to the substrate 70 first and then, in a subsequent step, the press-fit portion 16 of the electrical contact 10 is secured to the substrate 74, as described below. It is possible, however, for the securement to be performed in the opposite order.

The electrical contact 10 may be manipulated, such as by a "pick-and-place" machine, to place the mounting portion 36 of the electrical contact 10 on the pad 76 of the substrate 70, where it is soldered to form a bond between the mounting portion 36 and the pad 76. After the mounting portion 36 is soldered to the pad 76, the substrate 74 is manipulated to have the plated hole 80 aligned above press-fit portion 16 of the electrical contact 10. A downwardly-directed force (in the Y direction) is then applied to the substrate 74 to move the press-fit portion 16 into the hole 80.

As the press-fit portion 16 (relatively) moves into the hole 80, the beams of the press-fit portion 16 are deflected toward each other, thereby allowing the press-fit portion 16 to deform in the X direction and be securely disposed within the hole 80. In the longitudinal or Y direction, the first structure 12 maintains its rigidity and does not deform. The second structure 14, however, resiliently deflects in the Y direction to absorb some of the downwardly-directed force. If the substrates 70, 74 are misaligned, the second structure 14 will also deflect in the X direction and/or Z direction to absorb any force(s) in this/these direction(s). In so deflecting, the second structure 14 relieves some of the stress that would otherwise have been applied to the bond between the pad 76 of the substrate 70 and the mounting portion 36 of the electrical contact 10.

Figure 9:
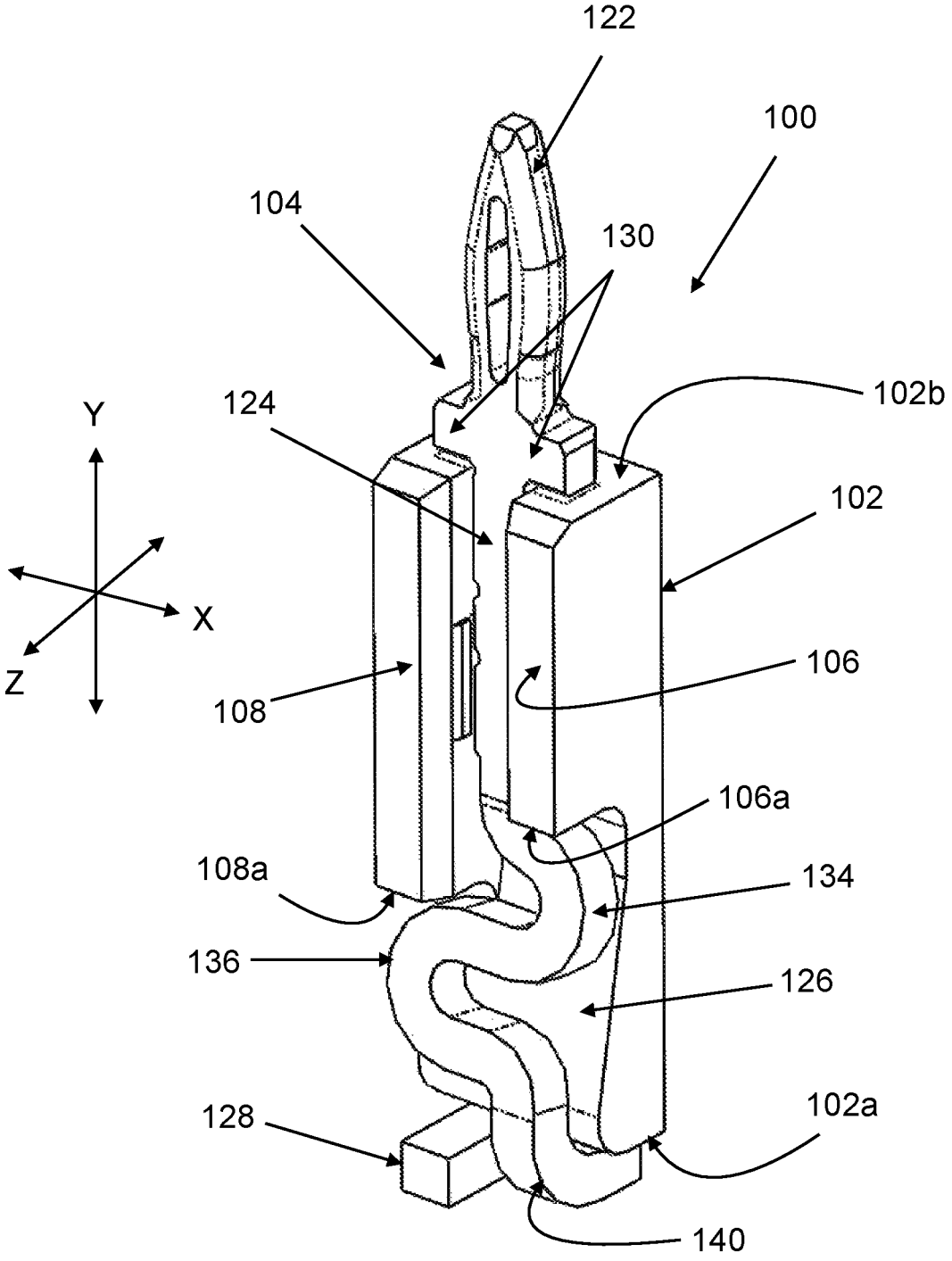
FIG. 9 shows a front perspective view of a second embodiment of an electrical contact.
Figure 10:
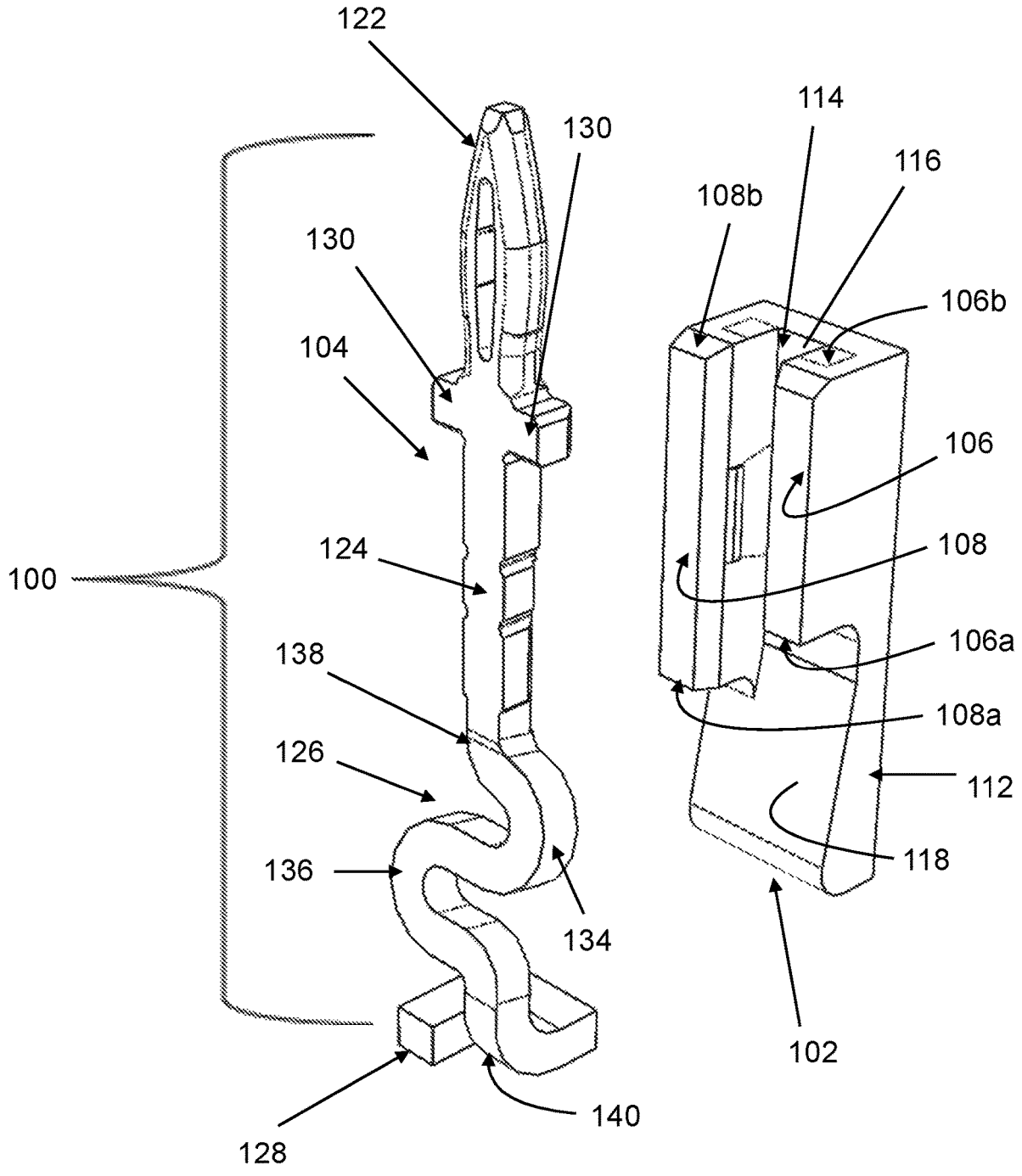
FIG. 10 shows an exploded front perspective view of the electrical contact of FIG. 9, wherein a first structure of the electrical contact is separated from a second structure of the electrical contact.
Figure 11:
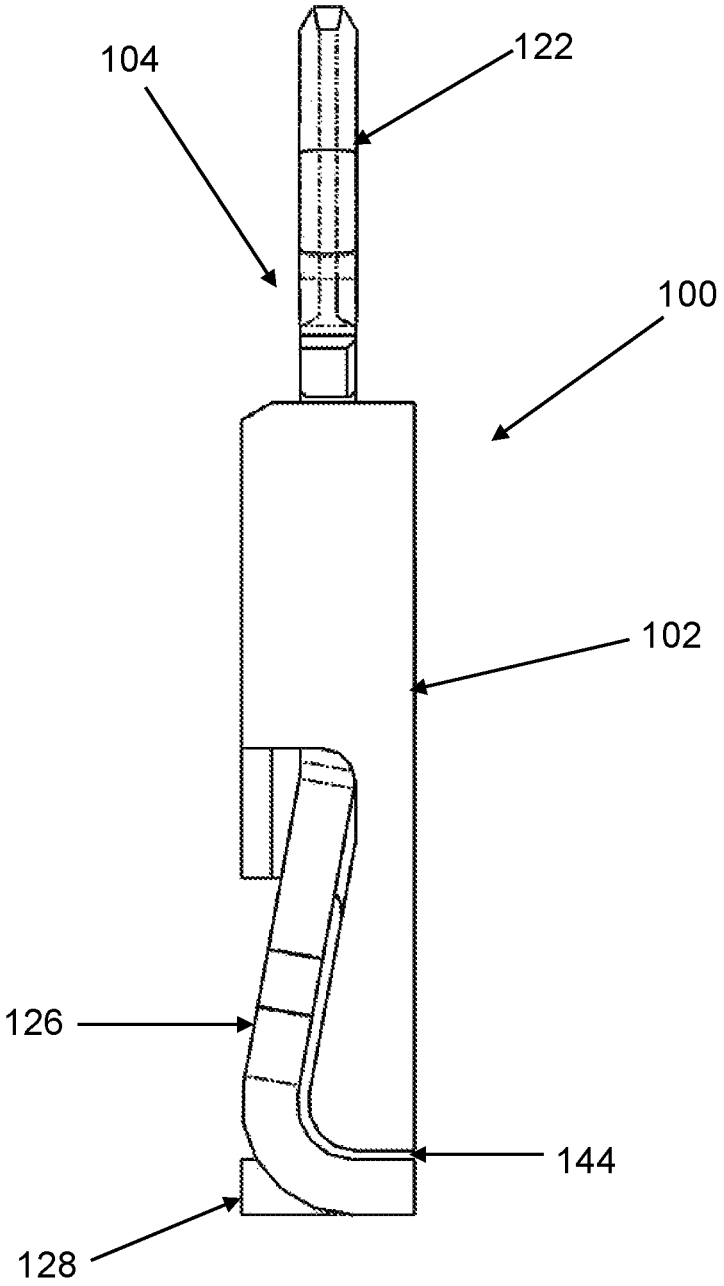
FIG. 11 shows a side view of the electrical contact of FIG. 9.

Referring now to FIGS. 9-11, there is shown a multi-part electrical contact 100 constructed in accordance with a second embodiment of this disclosure. The contact 100 is elongated, having a longitudinal axis that extends in the Y direction, a width extending in the X direction and a depth or thickness extending in the Z direction. The contact 100 has a two-part construction that includes a first structure 102 and a second structure 104. The first structure 102 is fastened to the second structure 104, as described below. The first structure 102 is comprised of plastic, while the second structure 104 is comprised of electrically conductive metal, such as a tin-plated copper alloy. As described below, the contact 100 is especially suited for connecting together two electrical/electronic substrates.

The first structure 102 is comprised of plastic and is rigid. The first structure 102 may be formed from any strong, stiff plastic. The plastic may also have good electrical insulating properties. Examples of such plastic include polybutylene terephthalate (PBT), nylon 6-6, and liquid crystal polymer (LCP). The first structure 102 has a lower end 102*a* and an upper end 102*b*. The first structure 102 includes first and second beams 106, 108 that are joined to a rear support wall 112 and extend forwardly therefrom. The second beam 108 extends downwardly farther than the first beam 106, such that a lower end 108*a* of the second beam 108 is disposed below a lower end 106*a* of the first beam 106. In addition, the second beam 108 extends outwardly (forwardly) farther than the first beam 106. The first and second beams 106, 108 are spaced-apart so as to form a groove 114 therebetween.

The rear support wall 112 of the first structure 102 includes an upper surface 116 and a lower surface 118. The upper surface 116 is disposed in a plane that is parallel to the longitudinal axis of the contact 100 and has an elongated opening extending therethrough. The lower surface 118 slopes downwardly and forwardly from the upper surface 116. Most of the upper surface 116 is disposed inside the groove 114, while the lower surface 118 is disposed below the groove 114.

The second structure 104 may be a unitary or monolithic structure and is comprised of electrically conductive metal, such as a tin-plated copper alloy. The second structure 104 includes a mounting or press-fit portion 122, a body portion 124, a spring portion 126 and a mounting portion 128.

The press-fit portion 122 is configured for press-fit insertion in the Y direction, into a plated hole of a printed circuit board (PCB) or other type of electrical/electronic substrate. The press-fit portion 122 may have an eye-of-the-needle construction (EON), with two beams separated by a piercing. The press-fit portion 122 is joined to the body portion 124. Both the press-fit portion 122 and the body portion 124 extend along the longitudinal axis. The body portion 124 includes a pair of shoulders 130 disposed proximate to the press-fit portion 122. The shoulders 130 extend in the X direction.

The spring portion 126 is joined between the body portion 124 and the mounting portion 128. The spring portion 126 slopes downwardly and forwardly from the body portion 124 so as to be disposed at an angle to the longitudinal axis. The spring portion comprises first and second lateral bends 134, 136 that are oppositely-directed. The first lateral bend 134 is disposed above the second lateral bend 136. An upper bend 138 connects the spring portion 126 to the body portion 124, while a lower bend 140 connects the spring portion 126 to the mounting portion 128. The mounting portion 128 may be L-shaped and has a substantially flat bottom surface so as to be adapted for securement, such as by soldering, to a pad of an electrical/electronic substrate, such as a PCB. The bends 134, 136, 138, 140 permit the spring portion 126 to be resiliently deflectable in the longitudinal or Y direction, as well as in the X direction and the Z direction.

The body portion 124 of the second structure 104 is pressed into the groove 114 of the first structure 102 so as to be held therein through a friction fit. The shoulders 130 of the second structure 104 adjoin, or are in close proximity to, the upper ends 106*b*, 108*b* of the first and second beams 106, 108, respectively, while the lower end 106*a* of the first beam 106 adjoins, or is in close proximity to, a top portion of the first lateral bend 134 and the lower end 108*a* of the second beam 108 adjoins, or is in close proximity to, a top portion of the second lateral bend 136. Thus, the first beam 106 is trapped between one of the shoulders 130 and the first lateral bend 134, and the second beam 108 is trapped between the other one of the shoulders 130 and the second lateral bend 136. In this manner, the first structure 102 is substantially prevented from moving in the longitudinal or Y-direction relative to the second structure 104.

With the body portion 124 of the second structure 104 held in the groove 114 of the first structure 102 as described above, the spring portion 126 of the second structure 104 is disposed adjacent to, and may be parallel to, the sloping lower surface 118 of the first structure 102. In addition, the first structure 102 is positioned between the shoulders 30 and the mounting portion 128 of the second structure 104, with a small space or gap 144 (shown in FIG. 11) being located between the lower end 102*a* of the first structure 102 and the mounting portion 128.

Figure 12:
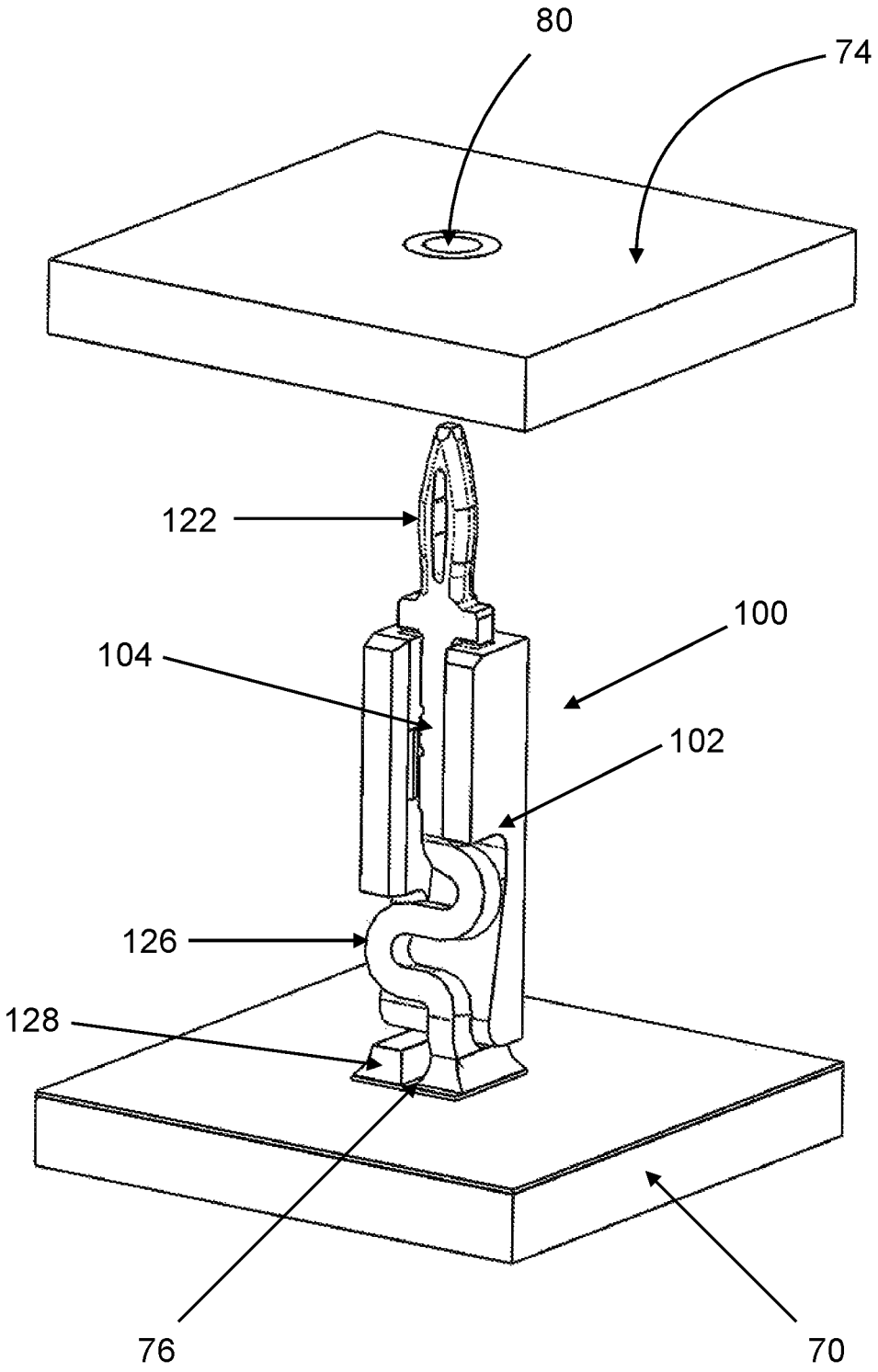
FIG. 12 shows a front perspective view of the electrical contact of FIG. 9 mounted to the first electrical/electronic substrate, with the second electrical/electronic substrate being spaced above the electrical contact and the first printed circuit board.

Referring now to FIG. 12, the electrical contact 100 is especially well suited for connecting together spaced-apart substrates, such as the substrate 70 and the substrate 74, described above. Typically, the mounting portion 128 of the electrical contact 100 is secured to the substrate 70 first and then in a subsequent step, the press-fit portion 122 of the electrical contact 100 is secured to the substrate 74, as described below. It is possible, however, for the securement to be performed in the opposite order.

The electrical contact 100 may be manipulated, such as by a "pick-and-place" machine, to place the mounting portion 128 of the electrical contact 100 on the pad 76 of the substrate 70, where it is soldered to form a bond between the mounting portion 128 and the pad 76. After the mounting portion 128 is soldered to the pad 76, the substrate 74 is manipulated to have the plated hole 80 aligned above press-fit portion 122 of the electrical contact 100. A downwardly-directed force (in the Y direction) is then applied to the substrate 74 to move the press-fit portion 122 into the hole 80, which causes the beams of the press-fit portion 122 to deflect toward each other and become securely disposed within the hole 80.

The first structure 102 provides a reaction force to the shoulders 130 of the second structure 104 as the downwardly-directed force is applied to the press-fit portion 122. The first structure 102 maintains its rigidity and does not deform in the Y-direction or otherwise; however, the gap 144 permits the first structure 102 (and the body portion 124 of the second structure 104) to move downward, toward the mounting portion 128. This downward movement is accommodated by the spring portion 126, which resiliently deflects in the Y direction to thereby absorb some of the downwardly-directed force. If the substrates 70, 74 are misaligned, the spring portion 126 will also deflect in the X direction and/or Z direction to absorb any force(s) in this/these direction(s). In so deflecting, the spring portion 126 relieves some of the stress that would otherwise have been applied to the bond between the pad 76 of the substrate 70 and the mounting portion 128 of the electrical contact 100.

As can be appreciated, the first structure 102 helps support and stabilize the second structure 104 to prevent it from being deformed too much when a downwardly-directed force is applied to the press-fit portion 122. In this regard, the first structure 102 will abut the mounting portion 128 of the second structure 104 after the spring portion 126 compresses by the amount of the gap 144.

Figure 13:
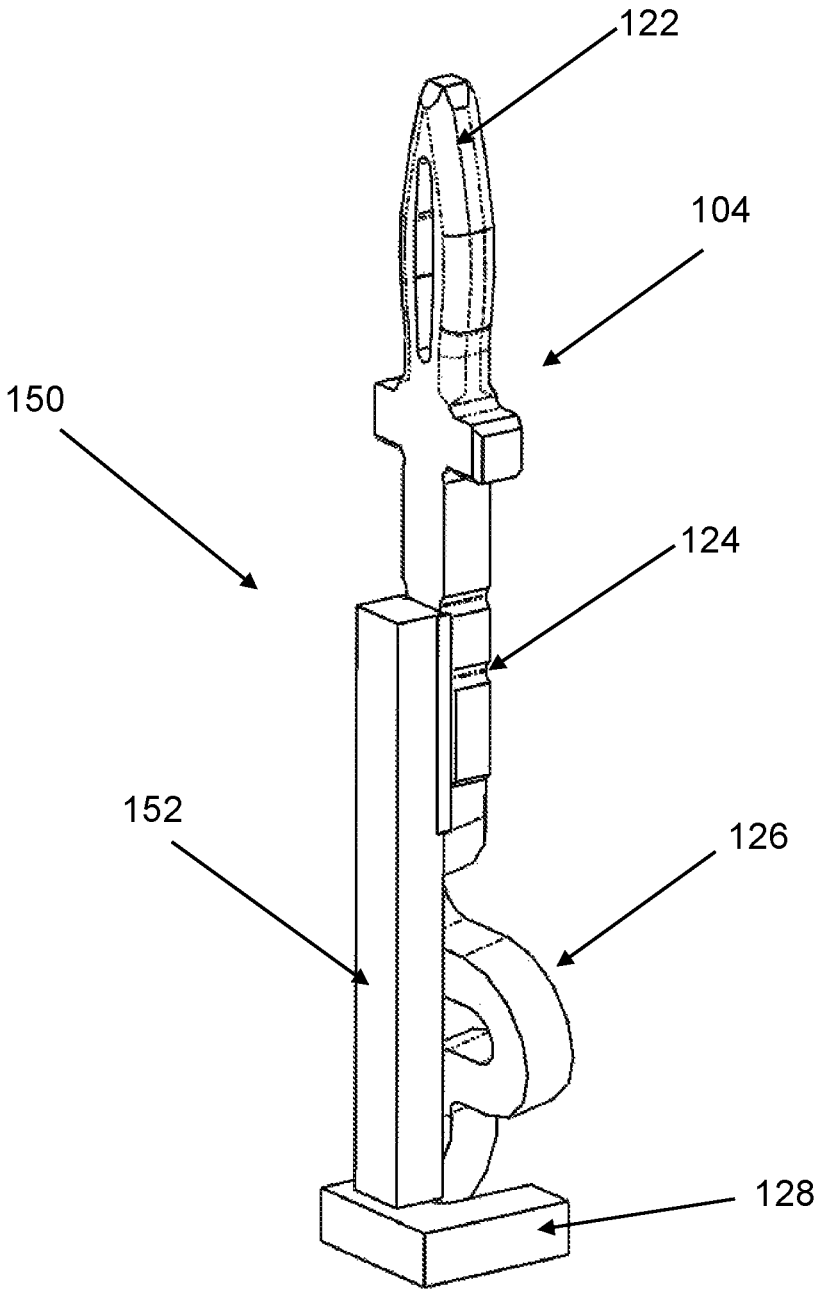
FIG. 13 shows a rear perspective view of a third embodiment of an electrical contact.
Figure 14:
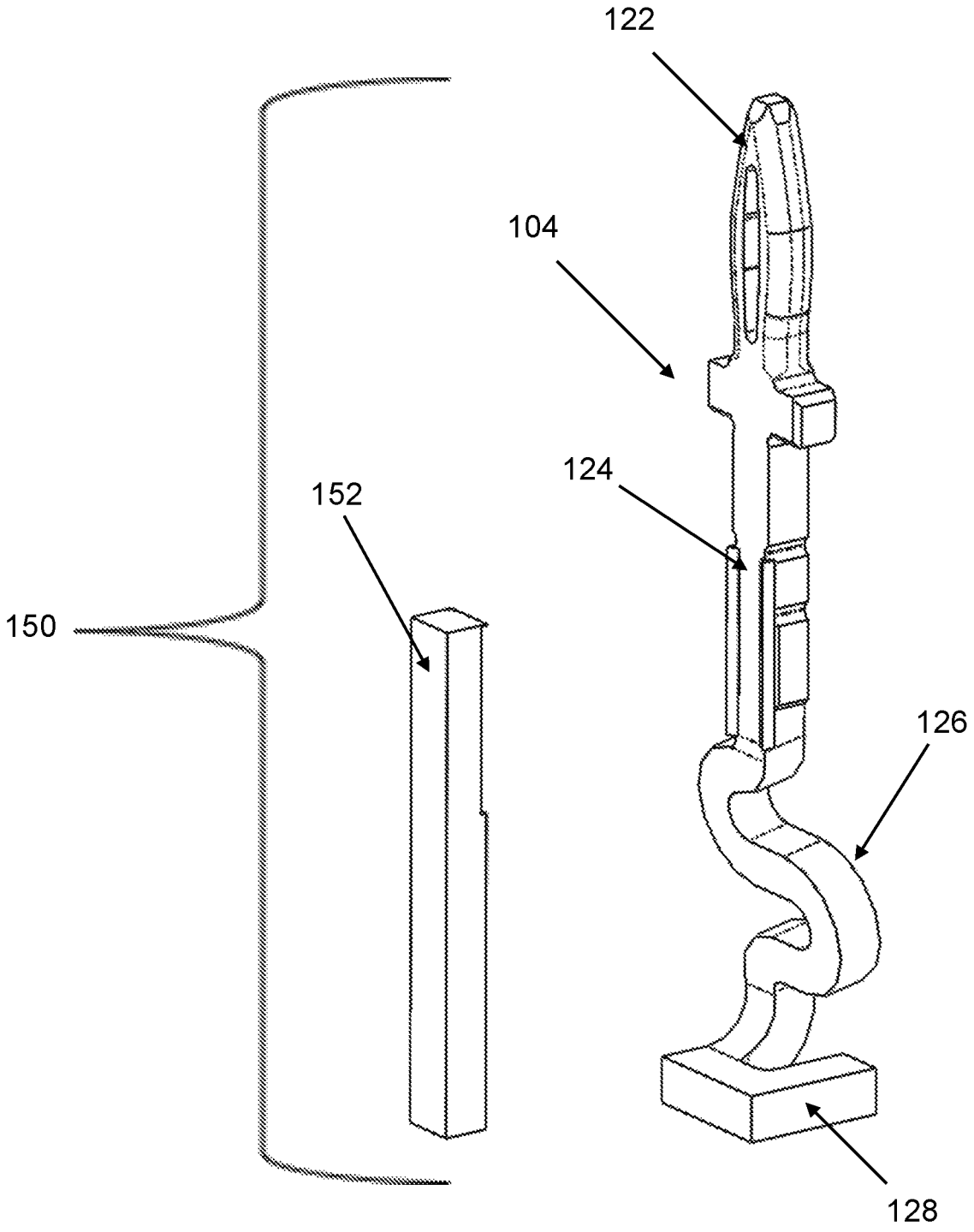
FIG. 14 shows an exploded rear perspective view of the electrical contact of FIG. 13, wherein a first structure of the electrical contact is separated from a second structure of the electrical contact.
Figure 15:
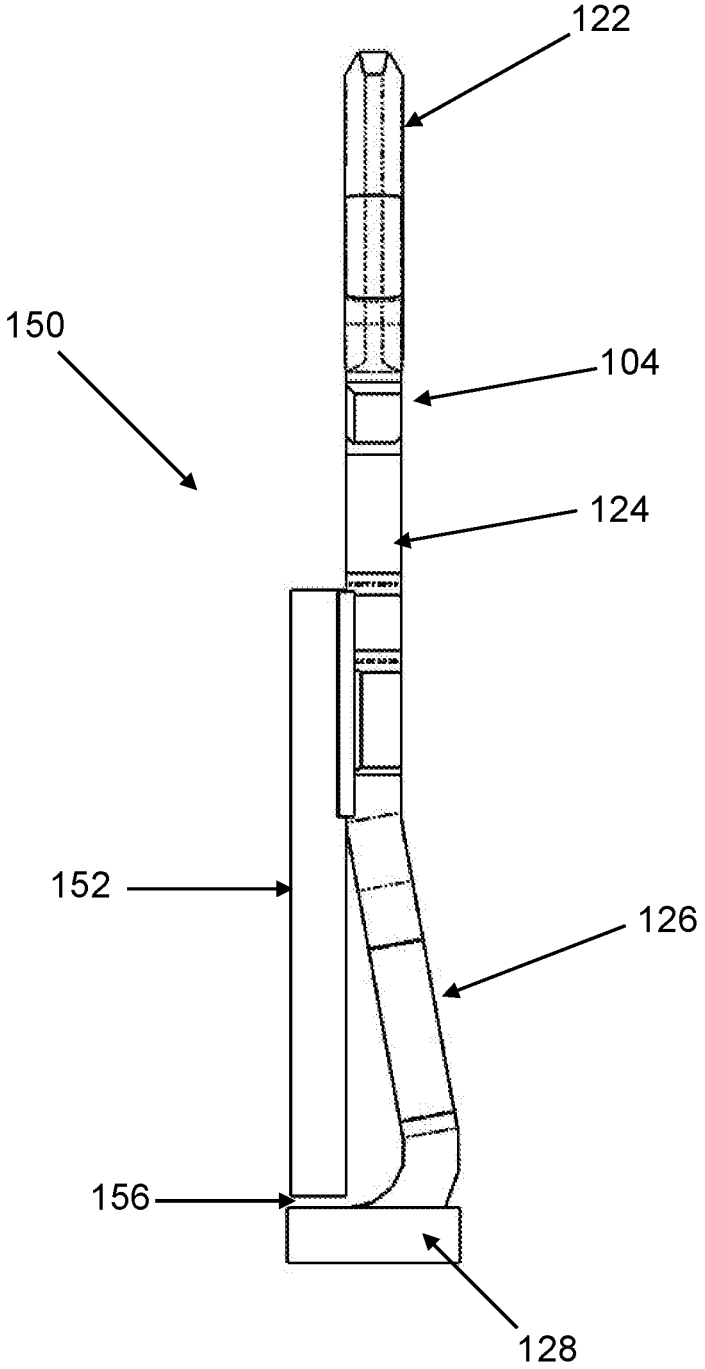
FIG. 15 shows a side view of the electrical contact of FIG. 13.

Referring now to FIGS. 13-15, there is shown a multi-part electrical contact 150 constructed in accordance with a third embodiment of this disclosure. The contact 150 has the same construction and function as the contact 100, except as described below. Instead of having a first structure 102, the contact 150 has a first structure 152. The first structure 152 is elongated and is comprised of metal, preferably the same metal as that used to form the second structure 104, such as a tin-plated copper alloy.

An upper portion of the first structure 152, which may be recessed, is welded to the body portion 124 of the second structure 104, such as by resistive, laser, e-beam, or ultrasonic welding. When the first structure 152 is secured to the second structure 104, a small space or gap 156 (shown in FIG. 15) is formed between a lower end of the first structure 152 and the mounting portion 128 of the second structure 104. This gap 156 is similar to the gap 144 in the contact 100 and also permits the spring portion 126 to deflect in the Y direction to absorb some of a downwardly-directed force that is applied to the press-fit portion 122, such as when the contact 150 is used to connect together spaced-apart substrates, such as the substrate 70 and the substrate 74.

When the contact 150 is used to connect together spaced-apart substrates, such as the substrate 70 and the substrate 74, the downwardly-directed force applied to the substrate 74 is not transferred to the first structure 152 through the shoulders 130, as in the contact 100. Instead, a portion of the force may be transferred to the first structure 152 through the weld between the first structure 152 and the body portion 124 of the second structure 104 (when the first structure 152 contacts the mounting portion 18). The first structure 152, however, still helps support and stabilize the second structure 104 to prevent it from being deformed too much. In this regard, the first structure 152 will abut the mounting portion 128 of the second structure 104 after the spring portion 126 compresses by the amount of the gap 156.

It is to be understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. An electrical contact for connecting together substrates, the electrical contact having a longitudinal axis and comprising:

a first structure extending along the longitudinal axis and having a rigid construction;

a second structure that includes a spring portion and a mounting portion, the spring portion being resiliently deflectable in the direction of the longitudinal axis, and the mounting portion having a planar bottom surface;

wherein one of the first and second structures includes a press-fit portion extending along the longitudinal axis and adapted for press-fit insertion into a hole;

wherein the first and second structures are connected together to prevent relative movement between each other in at least the direction of the longitudinal axis; and wherein the first structure is comprised of conductive metal and includes the press-fit portion, wherein the second structure is comprised of conductive metal, and wherein the first structure is secured to the second structure by one or more welds.

2. The electrical contact of claim 1, wherein the first structure is stamped from a first metal plate and wherein the second structure is stamped from a second metal plate, and wherein the first metal plate is at least twice as thick as the second metal plate.

3. The electrical contact of claim 1, wherein the spring portion comprises oppositely-directed first and second bends.

4. The electrical contact of claim 1, wherein the second structure further includes a support portion that is welded to, and overlays, the first structure, the support portion being disposed in a first plane that extends in the direction of the longitudinal axis, and wherein the mounting portion of the first structure extends in a second plane that is normal to the first plane.

5. The electrical contact of claim 1, wherein the press-fit portion of the one of the first and second structures comprises a pair of beams separated by a piercing.

6. An electrical assembly comprising the electrical contact of claim 1 and further comprising first and second substrates, the first substrate having a plated hole within which the press-fit portion of the one of the first and second structures is securely disposed, and the second substrate having a pad to which the mounting portion of the second structure is soldered.

7. The electrical contact of claim 3, wherein the spring portion further comprises a middle part joined between the first and second bends, and wherein the middle part is disposed parallel to the mounting portion of the second structure.

8. The electrical contact of claim 7, wherein the middle part has an opening through which a portion of the first structure extends.

9. The electrical contact of claim 4, wherein the spring portion of the second structure further comprises a middle part disposed in a third plane that is parallel to the second plane.

10. The electrical contact of claim 9, wherein the spring portion further comprises first and second bends, and wherein in a direction normal to the longitudinal axis, the support portion is disposed inward from both the first and second bends.

11. The electrical contact of claim 10, wherein the middle part of the second structure is joined between the first and second bends, and wherein an opening is formed in the spring portion through which a portion of the first structure extends, the opening comprising a slot that at least partially extends through the middle part and the second bend.

12. The electrical contact of claim 4, wherein the first structure further comprises a base portion that is connected by a body portion to the press-fit portion, the base portion being secured by welding to the support portion of the second structure, and the body portion having a pair of opposing side indentations; and wherein the support portion of the second structure has a pair of arms that extend upwardly and rearwardly so as to be at least partially disposed in the side indentations of the body portion of the first structure, respectively.

13. An electrical contact for connecting together substrates, the electrical contact having a longitudinal axis and comprising:

a first structure extending along the longitudinal axis and having a rigid construction; and a second structure comprised of conductive metal and including:

a spring portion resiliently deflectable in the direction of the longitudinal axis a mounting portion having a planar bottom surface;

a press-fit portion extending along the longitudinal axis and being adapted for press-fit insertion into a hole; and a body portion joined between the press-fit portion and the spring portion, the body portion including a pair of shoulders disposed toward the press-fit portion;

wherein the first and second structures are connected together to prevent relative movement between each other in at least the direction of the longitudinal axis;

wherein the spring portion slopes forwardly from the body portion so as to be disposed at an angle to the longitudinal axis, and wherein the spring portion comprises first and second lateral bends; and wherein the first structure has an upper end and a lower end, the upper end being disposed below the shoulders of the second structure and the lower end being disposed above the mounting portion of the second structure, and wherein the first structure is fastened to the body portion of the second structure.

14. The electrical contact of claim 13, wherein the first structure is comprised of conductive metal and is welded to the body portion of the second structure.

15. The electrical contact of claim 13, wherein the first structure is comprised of plastic and includes a groove, within which the body portion of the second structure is disposed and held by a friction fit.

16. The electrical contact of claim 15, wherein the first structure comprises a rear support wall having first and second beams joined thereto and extending forwardly therefrom, the first and second beams being spaced apart to form the groove, and wherein the second beam extends downwardly farther than the first beam, and wherein the first lateral bend of the second structure is disposed just below a lower end of the first beam and the second lateral bend of the second structure is disposed just below a lower end of the second beam.

* * * * *